United States Patent [19]

McMasters

[11] 4,180,940

[45] Jan. 1, 1980

[54] GRAVITY ACTUATED TOY DEVICE

[76] Inventor: Walter E. McMasters, 801 Elbert St., Defiance, Ohio 43512

[21] Appl. No.: 941,409

[22] Filed: Sep. 11, 1978

[51] Int. Cl.[2] ..... A63H 19/00

[52] U.S. Cl. ..... 46/216; 46/1 R; 273/109

[58] Field of Search ..... 46/1 R, 1 K, 43, 47, 46/216; 273/86 C, 109; 104/56, 57

[56] References Cited

U.S. PATENT DOCUMENTS

| | | | |
|---|---|---|---|
| 2,596,688 | 5/1952 | Hinsen | 46/1 R X |
| 2,877,597 | 3/1959 | Brant | 46/1 R X |
| 4,062,543 | 12/1977 | Loeffler | 273/86 C X |

FOREIGN PATENT DOCUMENTS

| | | | |
|---|---|---|---|
| 1958218 | 6/1971 | Fed. Rep. of Germany | 46/216 |
| 2504011 | 8/1975 | Fed. Rep. of Germany | 104/56 |
| 174694 | 4/1935 | Switzerland | 46/1K |

*Primary Examiner*—Charles E. Phillips

*Attorney, Agent, or Firm*—Clarence A. OBrien; Harvey B. Jacobson

[57] ABSTRACT

The device has a pair of paddle-like handles with each handle having a groove disposed therein for connection to opposite ends of a helical spring. A small car having a series of rollers disposed therein is mounted upon the spring for movement along the helical coils thereof. When the paddles are held in a position vertically spaced from each other, the coils of the spring are separated and the car is allowed to traverse the length of the spring following a helical path as defined by these coils.

7 Claims, 6 Drawing Figures

GRAVITY ACTUATED TOY DEVICE

BACKGROUND OF THE INVENTION

1. Field of the Invention

This invention relates to toys, games and other amusement devices especially such devices which function as an eye exerciser or have therapeutic value as a muscle exerciser.

2. Description of the Prior Art

Various games and other amusement devices have been known in the prior art in which an element of the device follows a helical path defined by a spring. However, such devices do not provide for a smooth progression of the moving element over the coils of the spring. Examples of prior art games incorporating the spring and moving element concept include U.S. Pat. No. 2,596,688, isssued May 13, 1952, to Hinsen, which shows a spiral game wherein a pair of ducks are mounted upon a single stiffly coiled wire with the object of the game being to move the ducks in opposite directions along the coils of the wire when disposed in a horizontal plane. U.S. Pat. No. 2,877,597, issued Mar. 17, 1959, to Brant, shows a gravity actuated whirling ring toy wherein a series of rings are allowed to follow a helical path along a spiral wire and thereby provide amusement. U.S. Pat. No. 4,062,543, issued Dec. 13, 1977, to Loeffler, shows a helical spring game which includes a spring positioned vertically on a base and a plurality of travelling means positioned slidably along the length of the spring between the top and the bottom thereof. The spring is displaced from its vertical position and released. This allows the spring to vibrate producing movement in the travelling means.

SUMMARY OF THE INVENTION

An object of the invention is to provide a simple, safe amusement device whereby a car may be allowed to traverse the coils of a helical spring and wherein movement of the car may be affected by motion of the ends of the spring through manipulation of hand held paddles. The speed of the car may be varied by increasing or decreasing the distance between the paddles and thereby effecting the slope of the spring coils.

An additional object of the present invention is to provide a travelling car element for disposition upon the coils of a spring which car element is given maximum mobility by the inclusion therein of several rollers which are positioned to contact the coils of the spring.

Yet a still further object of the present invention is to provide a toy of the above described nature wherein the spring is produced of substantially flat wire, thereby providing a substantially constant orientation to the car while travelling along the spring coils.

Yet a still further object of the present invention is to provide a toy device wherein eye exercising may be accomplished by the visual following of the car along its circuitous route.

Yet a still further object of the invention is to provide a spring and travelling car toy device which provides the user with a measure of therapeutic value for the arm and shoulder muscles. This is accomplished by providing sufficient spring tension to the helical spring to force the muscles of the aforementioned arm and shoulder to be exercised.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
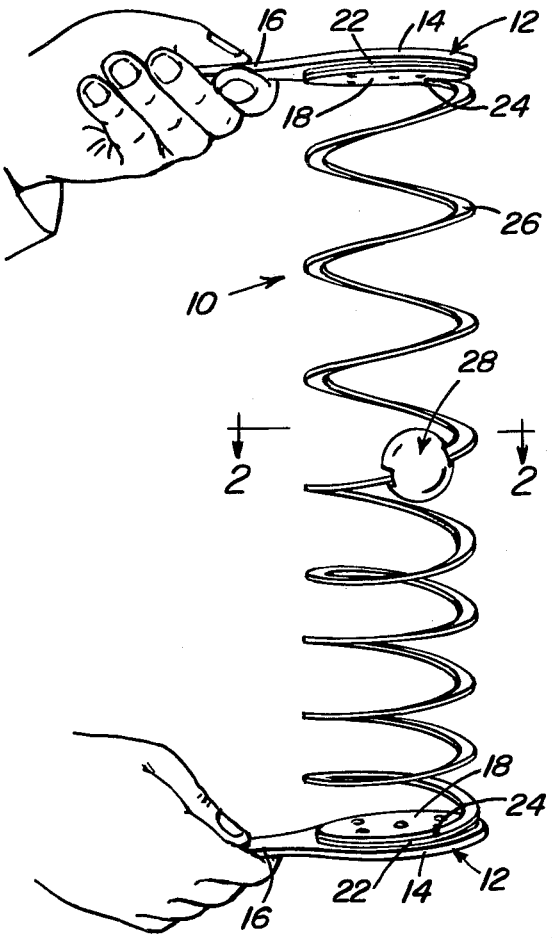
FIG. 1 is a perspective view of the device of the present invention.
Figure 2:
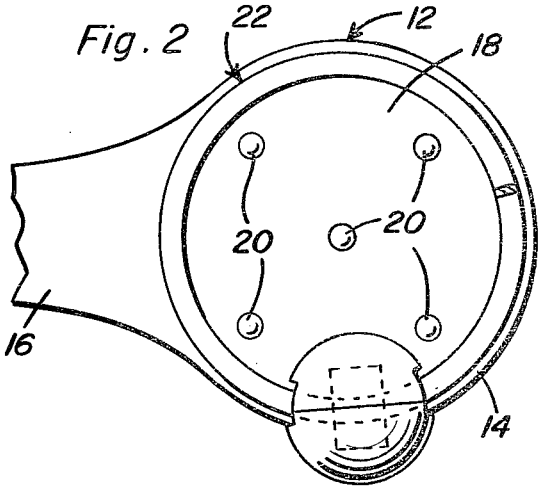
FIG. 2 is a sectional view taken substantially along a plane passing through section line 2—2 of FIG. 1 and showing one of the paddle devices of the invention.

Now with reference to the drawing, the toy device of the present invention will be described wherein the device is generally referred to by the numeral 10. The device consists of two handles 12 formed in a paddlelike configuration with a widened circular head 14 and a hand gripping area 16. Each handle has a retaining plate 18 connected thereto by means of nuts and bolts shown generally at 20 or any other adequate securing means. A circular groove 22 is formed in the retaining plate 18 and is disposed between the outer face of retaining plate 18 in the handle 12. A slit 24 is formed in the outer face of retaining plate 12 over groove 22 in order to allow entry of spring 26 into the groove.

Spring 26 is formed from a substantially flat material thus providing major surfaces on the top and bottom of each coil thereof. Spring 26 extends between the two handles 12 and is secured by its connection to groove 22 between retaining plate 18 and handle 12.

Figure 3:
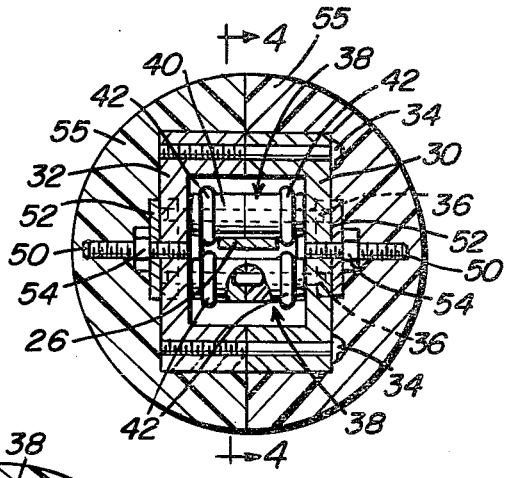
FIG. 3 is an elevational sectional view of the travelling car of the present invention.
Figure 4:
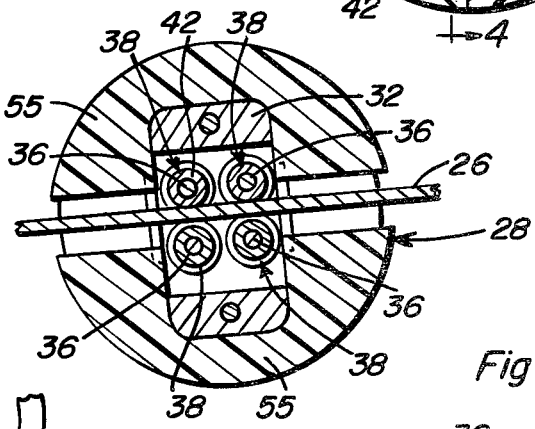
FIG. 4 is a sectional view taken substantially along a plane passing through section line 4—4 of FIG. 3.

Travelling car 28 is disposed upon spring 26 with the spring passing therethrough. In FIG. 3 it will be seen that the car 28 consists of a pair of symmetrical frame members 30 and 32 with the frame members connected by bolts 34 to form a rectangular configuration having an open center. Four axles 36 pass through holes in frame members 30 and 32 disposed therefor. Rotatably mounted upon each axle are two rollers 38. Each roller has a cylindrical center portion 40 which has a width slightly greater than one-half the width of one major surface of the spring 26. At one end of the cylindrical portion is an annular flange 42. The rollers are mounted upon each axle in symmetrical pairs such that one flange rides adjacent each outer edge of spring 26 and thereby the spring is maintained in position upon the roller pair. The eight rollers 38 are positioned with four rollers spaced above and four rollers spaced below the spring. The flanges of the vertically spaced rollers are spaced such that the gap therebetween is less than the thickness of the spring thus ensuring that the spring will not slip between them. The rollers positioned along the length of the spring are provided to ensure against any twisting motion of the travelling car 28.

Studs 50 are connected to each frame member. Disposed over the studs are retaining clips 52 which are held in place by nuts 54. The retaining clips cover the holes in which the axles 36 are placed in order to insure that the axles will not be allowed to slide out of their mounting holes.

With the configuration as described, travelling car 28 is maintained in a position upon spring 26 which will not allow for any angular movement of the car with respect to the spring. In this way, the car travels directly over the coils of the spring without any additional twisting or turning motion.

Figure 5:
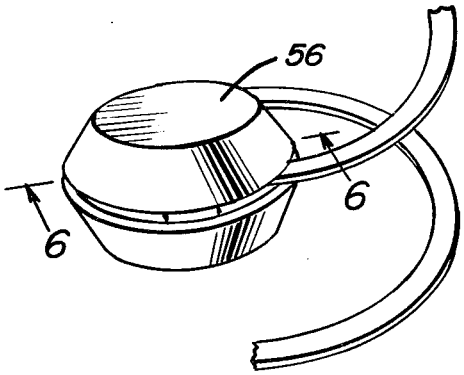
FIG. 5 shows a second embodiment of the travelling car of the invention.
Figure 6:
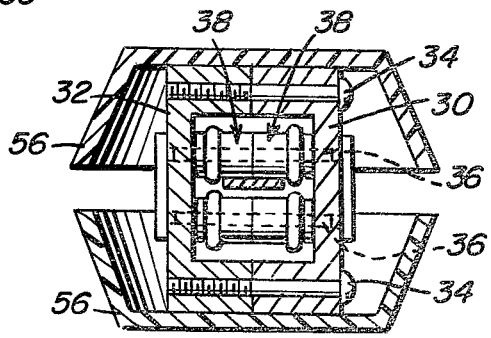
FIG. 6 is a sectional view taken substantially along a plane passing through section line 6—6 of FIG. 5.

To provide the car with aesthetic appeal, rubber ball halves 55 are connected to the frame members by the use of glue or any other suitable means. Alternatively, with reference to FIGS. 5 and 6, it may be seen that a flying saucer appearance may be given to the car by the disposition of top and bottom plates 56 on the frame portions thereof. These plates may be made of plastic, metal, or any other suitable material and are provided for decorative appearance only.

In use, the device is manipulated by grasping the handles individually and vertically orienting the spring to allow the car 28 to move under the influence of gravity over the coils of the spring. The speed of the car may be controlled by expanding or contracting the spring through the use of the handles. When the spring reaches one end, the entire device may be inverted whereby the car will return toward the opposite handle. In this manner, by visually following the ball, eye exercises may be effected and also due to the force exerted by the spring 26, muscle therapy may be produced. However, it should be noted that the spring constant of spring 26 is not sufficient to enable the spring to stand upright without aid. That is, the spring will collapse under its own weight. In this manner the spring is certain to be sufficiently flexible to ensure its ability to be manipulated.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A toy device comprising a pair of handles; a substantially flat spring formed in a helix, a pair of attachment plates connected respectively to each handle with the ends of the spring attached between the connecting plates and handles; a movable element having rollers disposed therein movably engaging the spring with the rollers disposed in spaced relation above and below the material of the spring.

2. The device of claim 1 wherein the rollers consist of eight rollers with two pairs of rollers disposed above the spring and two pairs of rollers disposed below the spring.

3. The device of claim 2 wherein the rollers have a cylindrical portion which is of substantially the same width as a major surface of the material from which the spring is formed.

4. The device of claim 3 and further including frame means mounting said rollers.

5. The device of claim 4 and further including decorative covering means covering said frame and rollers and including at least one slot therein through which the spring coils pass.

6. The device of claim 5 wherein said decorative covering means is a hollowed out rubber ball.

7. The device of claim 5 wherein said decorative covering means comprises a pair of saucers having one open end wherein the open ends of the saucers face each other.

* * * * *